United States Patent [19]

Penney

[11] Patent Number: 4,989,557

[45] Date of Patent: Feb. 5, 1991

[54] SPARK PLUG ASSEMBLY FOR INTERNAL COMBUSTION ENGINE

[75] Inventor: Keith A. Penney, Davison, Mich.

[73] Assignee: General Motors Corporation, Detroit, Mich.

[21] Appl. No.: 513,300

[22] Filed: Apr. 25, 1990

[51] Int. Cl.[5] ..... F02P 15/00

[52] U.S. Cl. ..... 123/169 EL; 123/169 R; 123/193 H; 313/144

[58] Field of Search ..... 123/169 EL, 169 R, 193 H, 123/647; 313/144, 118

[56] References Cited

U.S. PATENT DOCUMENTS

| | | | |
|---|---|---|---|
| 1,228,487 | 6/1917 | Sessions . | |
| 1,500,161 | 7/1924 | Sykes | 313/144 |
| 2,038,042 | 4/1936 | Hansen | 123/169 |
| 2,252,636 | 8/1941 | Kohout et al. | 123/169 |
| 2,309,236 | 1/1943 | Burrell et al. | 313/144 |
| 3,534,714 | 10/1970 | Urlaub | 123/169 |
| 4,007,714 | 2/1977 | Jones | 123/8.09 |
| 4,901,687 | 2/1990 | Jones | 123/169 R |

*Primary Examiner*—Andrew M. Dolinar

*Attorney, Agent, or Firm*—Douglas D. Fekete

[57] ABSTRACT

An internal combustion engine includes a cylinder head and a spark plug assembly adapted to be received in a cylinder head bore. The spark plug assembly includes a metal ground electrode element having an annulus disposed on a transverse annular seat of the cylinder head bore and a ground side electrode extending from the annulus. The ground side electrode is received in an axial slot of the cylinder head bore between the seat and a cylinder head inner wall and protrudes into the combustion chamber. The orientation of the ground electrode relative to the cylinder head, and thus to the geometry of the combustion chamber, is established by the circumferential location of the axial slot relative to the bore. The spark plug assembly also includes a center electrode element having a center electrode and surrounding insulator body. The insulator body includes a shoulder that is clamped against the ground electrode annulus on the seat by a spanner retainer nut threaded into the cylinder head bore about the insulator body. The ground electrode element and the center electrode element are thereby secured in position in the cylinder head bore.

10 Claims, 1 Drawing Sheet

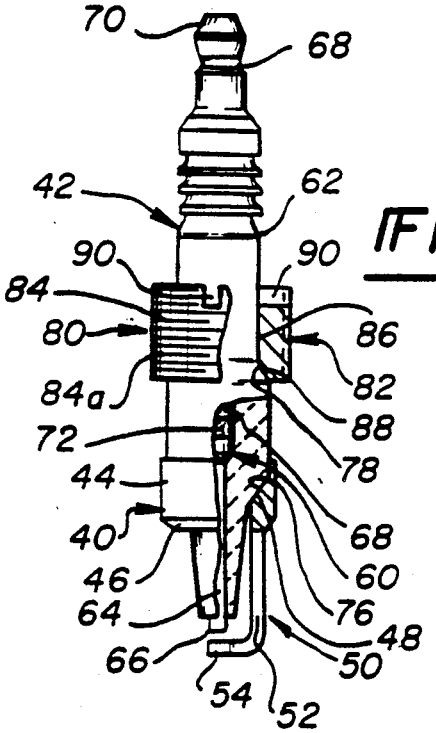
Fig-2
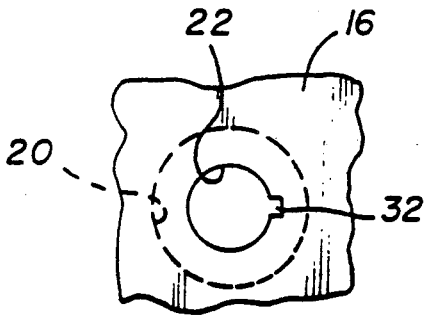
Fig-3
Fig-1
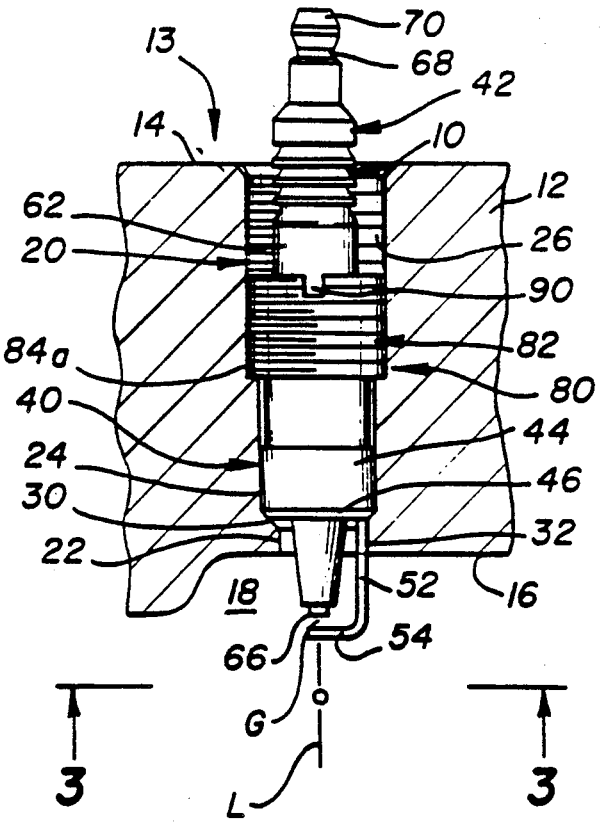

SPARK PLUG ASSEMBLY FOR INTERNAL COMBUSTION ENGINE

FIELD OF THE INVENTION

The present invention relates to a spark-ignition internal combustion engine and, more particularly, to a spark plug assembly installed within a cylinder head of the engine.

BACKGROUND OF THE INVENTION

A common spark plug for an internal combustion engine comprises a center electrode enclosed in an elongated ceramic body and an L-shaped side electrode attached to a metal shell crimped about the ceramic body. At the tip of the spark plug, the center electrode protrudes from the ceramic body and is spaced apart from the side electrode to form a spark gap. The metal shell includes screw threads to allow the spark plug to be installed in a cooperatively threaded bore of a cylinder head such that the tip extends within a combustion chamber of the engine. The center electrode is connected to an external electrical circuit at an outer terminal, whereas the side electrode is electrically connected through the metal shell to the engine block, which is electrically grounded. During engine operation, an electrical potential applied to the center electrode relative to the grounded side electrode generates a spark across the gap to ignite a fuel-air mixture within the combustion chamber.

It is believed engine performance may be affected by the orientation of the side electrode within the combustion chamber, for example, relative to an intake port or exhaust port. The optimum side electrode orientation may depend upon combustion chamber design and may vary even between combustion chambers of a multi-cylinder engine For a common spark plug that is threaded into a cylinder head bore and sealed against a seat therein, the orientation of the side electrode is random and uncontrolled. Thus, it has been necessary to employ costly and cumbersome techniques in order to achieve a desired side electrode orientation. For example, in racing engines or test engines, a desired orientation is achieved by an indexing technique which may involve trial of as many as a thousand commercial spark plugs to identify one spark plug wherein the random orientation of the side electrode corresponds to the desired orientation for the particular cylinder This also necessitates removal of the cylinder head to ascertain the orientation of the side electrode. Such techniques are too laborious, costly and time consuming for general use in automobiles.

It is an object of the present invention to provide an internal combustion engine comprising a spark plug assembly having a side electrode and installed in a cylinder head such that the side electrode is located in a predetermined orientation within the combustion chamber.

It is a more particular object of the present invention to provide an internal combustion engine comprising a spark plug assembly mounted in a bore of a cylinder head, which assembly comprises a side electrode received in a slot in the bore wall to achieve a predetermined orientation within the combustion chamber, and further comprises locking means for securing the spark plug assembly, including the side electrode, within the cylinder head. The locking means is threaded into the bore independent from the side electrode to permit the spark plug to be secured without altering the side electrode orientation.

SUMMARY OF THE INVENTION

The present invention contemplates an internal combustion engine having a spark plug assembly mounted in a cylinder head in a manner to provide positive control of the orientation of a ground electrode relative to the geometry of the combustion chamber.

The cylinder head includes an outer wall, an inner wall forming at least a portion of the combustion chamber and an axial spark plug-receiving, cylinder head bore between the cylinder head outer and inner walls. The cylinder head bore includes an annular transverse seat disposed between the outer and inner cylinder head walls generally facing the outer wall and an axial slot extending between the seat and the cylinder head inner wall.

The spark plug assembly comprises a ground electrode element and a center electrode element replaceably secured in the cylinder head bore. The ground electrode element includes an annulus disposed on the bore seat and an elongated ground electrode extending from the annulus and received in the axial slot for protruding into the combustion chamber at a predetermined orientation controlled by the circumferential location of the slot relative to the cylinder head bore.

The center electrode element includes a center electrode and a surrounding insulator (dielectric) body. The insulator body includes an annular shoulder for engaging the ground electrode annulus on the seat. The insulator body shoulder is clamped against the ground electrode annulus on the seat by locking means cooperatively engaging the cylinder head and the insulator body. The preferred locking means is threaded into the bore about the insulator body and engages the insulator body to secure the assembly independent from the ground electrode element so as not to disturb the orientation of the ground electrode.

The aforementioned objects and advantages of the invention will become more readily apparent from the following detailed description taken with the drawings

BRIEF DESCRIPTION OF THE DRAWINGS

FIG. 1 is a cross-sectional view of a portion of an internal combustion engine cylinder head showing a spark plug assembly in accordance with the invention secured in the cylinder head bore.

FIG. 2 is an elevational view, partially sectioned, of the spark plug assembly in accordance with the invention.

FIG. 3 is a bottom elevational view of the cylinder head taken along arrows 3—3 of FIG. 1 with the spark plug assembly deleted to clearly show the axial slot of the cylinder head bore.

DETAILED DESCRIPTION OF THE INVENTION

Referring to FIG. 1, in accordance with a preferred embodiment of this invention, a spark plug assembly 10 is secured in a cylinder head 12 of an internal combustion engine 13. The cylinder head 12 comprises an outer wall 14 and an inner wall 16 and is assembled to an engine block (not shown) to form a combustion chamber 18. The cylinder head 12 includes a spark plug-receiving bore 20 extending between outer wall 14 and inner wall 16 along a bore axis L. The cylinder head bore 20 comprises a first inner cylindrical bore portion 22 at the cylinder head inner wall 16, a second intermediate cylindrical bore portion 24 disposed axially outwardly of and adjacent to the inner bore portion 22, and an outer cylindrical threaded bore portion 26 at the cylinder head outer wall 14. As is apparent from FIG. 1, the diameter of the first bore portion 22 is less than the diameter of the axially adjacent second bore portion 24 to define an annular seat 30 transverse of the bore axis L and facing the cylinder head outer wall 14.

The cylinder head bore 20 also includes an axial slot 32 extending between the annular seat 30 and the cylinder head inner wall 16 for receiving the ground side electrode of the spark plug assembly 10. As will be explained hereinbelow, the axial slot 32 may be located circumferentially relative to the cylinder head bore 20 to provide a preferred orientation of the ground electrode relative to the geometry of the combustion chamber 18.

Referring to FIGS. 1 and 2, the spark plug assembly 10 comprises a metal ground electrode element 40 and a center electrode element 42. The ground electrode element 40 comprises an annulus 44 having an outer annular shoulder 46 adapted to engage the bore seat 30, FIG. 1, and an inner annular shoulder 48 adapted to engage the center electrode element 42 in a manner to be described. Ground electrode element 40 further comprises an L-shaped side electrode 50 affixed (e.g., welded) to annulus 44 and depending therefrom. The electrode 50 includes an axial portion 52 extending from the annulus 44 and received in the axial slot 32 of the cylinder head bore 20 and an inner end portion 54 extending transversely of the axial portion 52 for purposes to be described.

The axial slot 32 is located at a predetermined circumferential location relative to the cylinder head bore 20 to provide, when the spark plug assembly 10 is installed in the cylinder head bore 20, a preferred orientation of the ground electrode 50 relative to the geometry of the combustion chamber 18 for improved combustion efficiency. The orientation of the ground electrode 50 will depend on the particular combustion chamber geometry employed and may vary from cylinder to cylinder of the engine. The axial slot 32 is machined or otherwise formed in the cylinder head 12 to this end.

The center electrode element 42 comprises an axially elongated center electrode 60 and an axially elongated insulator (dielectric) body 62 surrounding the center electrode 60. The center electrode 60 includes an inner metallic portion 64 having an end tip 66 for protruding into the combustion chamber 18, an outer metallic portion 68 having an end 70 configured to engage a conventional spark plug lead wire boot (not shown), and an intermediate resistor glass seal 72 between the inner and outer portions 64,68. The resistor glass seal 72 is of the type generally known in the spark plug industry for providing gas sealing.

The axially elongated insulator body 62 is formed of an electrically insulative ceramic material and includes a first inner annular shoulder 76 for engaging the shoulder 48 of the ground electrode element 40, FIG. 2. An optional annular gasket (not shown) of copper, steel or other material may be located between the shoulders 48,76 for gas sealing purposes. A second outer annular shoulder 78 is provided on the insulator body 62 in axially spaced apart relation from the first shoulder 76 for engagement by locking means 80 to be described hereinbelow.

Those skilled in the art will appreciate from the description thus far that the center electrode element 42 does not include an outer metal (e.g., steel) shell of the type present on a conventional spark plug.

The locking means 80 referred to hereinabove preferably comprises an annular spanner retainer nut 82 shown in FIGS. 1–2. The spanner retainer nut 82 includes an annular metal (e.g., steel, aluminum, copper, etc.) body 84 having an outer, threaded peripheral portion 84*a* and an inner bore 86 to receive the insulator body 62. The inner bore 86 includes an annular shoulder 88 for engaging the outer shoulder 78 of the insulator body 62, FIG. 2. The upper end of the retainer nut 82 includes at least two and preferably four radial slots 90 (two shown) arranged in diametrically opposed pairs. The slots 90 are configured and circumferentially spaced apart so as to be engageable by a spanner wrench (not shown) for installation/removal of the spark plug assembly 10 relative to the cylinder head bore 20.

The ground electrode element 40, center electrode element 42 and spanner retainer nut 82 described hereinabove are initially provided to an assembly location (work station) as separate components for assembly with the cylinder head 12. To install the spark plug assembly 10 in the cylinder head bore 20, the ground electrode element 40 is first positioned in the cylinder head bore 20 with the annulus 44 disposed on the seat 30 and the ground electrode 50 received in the axial slot 32 for protruding into the combustion chamber 18, see FIG. 1. The center electrode element 42 is then inserted in the bore 20 until the insulator body shoulder 76 engages the ground electrode annulus 44 (i.e., the annulus shoulder 48) on the seat 30. Thereafter, the spanner retainer nut 82 is threaded into the outer threaded bore portion 26 to clamp the retainer nut shoulder 88 against the insulator body shoulder 78. As the retainer nut 82 is tightened, the insulator body shoulder 76 is sealingly clamped against the ground electrode annulus shoulder 48. This clamping action, in turn, places the ground electrode in intimate sealed, electrical and thermal conductive contact with the cylinder head bore seat 30. This clamping action thus releasably secures and seals the ground electrode element 40 and the center electrode element 42 in the cylinder head bore 20 with the center electrode end tip 66 and the ground electrode end portion 54 axially spaced apart to establish a desired spark gap G therebetween, FIG. 1.

In contrast to a conventional spark plug comprising a threaded metal shell crimped about the insulator body for securing the spark plug in a cylinder head bore, the shell-less design of spark plug assembly 10 and the use of spanner retainer nut 82 allows the diameter of the bore 20 to be reduced, particularly at the cylinder head outer wall 14. Moreover, the clearance space required for the spark plug installation/removal tool (e.g., a spanner wrench in lieu of a hexagonal drive socket) is also reduced. In addition, the size (e.g., diameter) of the center electrode insulator body can be reduced to further reduce the space occupied by the spark plug assembly 10 in the cylinder head 12. This increases the available space for other features typically found in the cylinder head, such as intake/exhaust valves, intake/exhaust passages, cam shafts and water jackets.

Furthermore, this invention provides positive control over the orientation of the ground electrode 50 relative to the cylinder head bore 20 and thus to the geometry of the combustion chamber 18. This is obtained without compromising the performance of the spark plug assembly 10 in terms of gas leakage, dielectric strength, mechanical strength, fouling resistance, idle stability and electrode life.

While the invention has been described in terms of specific embodiments thereof, it is not intended to be limited thereto but rather only to the extent set forth hereafter in the claims.

The embodiments of the invention in which an exclusive property or privilege is claimed are defined as follows:

1. An internal combustion engine comprising: (a) a cylinder head having an outer wall, an inner wall forming at least a portion of a combustion chamber, a spark plug-receiving bore between the outer and inner walls and having a bore axis, said bore having an annular seat disposed between the outer and inner walls generally facing the outer wall and an axial slot extending between the seat and the cylinder head inner wall, (b) a spark plug assembly received in the bore, said spark plug assembly comprising a ground electrode element having an annulus disposed on the seat and an elongated ground electrode extending from the annulus and received in said slot for protruding into the combustion chamber, and a center electrode element having a center electrode and a surrounding insulator body, said insulator body having an annular shoulder for engaging the annulus, said center electrode protruding into the combustion chamber and spaced apart from the ground electrode in said combustion chamber, and (c) locking means for cooperatively engaging the cylinder head and the insulator body to clamp the insulator body shoulder against the annulus on said seat, thereby securing the center electrode element and the ground electrode element in position in said cylinder head bore.

2. The engine of claim 1 wherein said bore includes a first bore portion extending from the cylinder head inner wall, a second bore portion disposed axially outwardly adjacent to said first bore portion and having a larger diameter than said first bore portion, whereby said annular seat is defined between the first and second bore portions.

3. The engine of claim 1 wherein said ground electrode element is formed of metal and is disposed on said seat in intimate electrical and thermal conductive contact with the cylinder head.

4. The engine of claim 1 wherein said elongated ground electrode comprises an L-shaped electrode having an axial portion received in said slot and an inner end portion extending transversely of said axial portion in said combustion chamber so as to be spaced apart axially from the center electrode to define an axial spark gap therebetween.

5. The engine of claim 1 wherein said locking means comprises an annular spanner retainer nut threadably received in a threaded portion of said bore about the insulator body to clamp the insulator body shoulder against the annulus on said seat.

6. For use with an internal combustion engine cylinder head having an outer wall, an inner wall forming at least a portion of a combustion chamber, and a spark plug-receiving bore between the outer and inner walls and having a bore axis, a spark plug assembly adapted to be secured in the cylinder head bore, said spark plug assembly comprising (a) a ground electrode element having an annulus received on a transverse annular seat disposed in said bore between said outer and inner walls generally facing the outer wall, and an elongated ground electrode extending from the annulus and received in an axial slot communicating with the bore between said seat and said cylinder head inner wall, said ground electrode protruding into the combustion chamber and (b) a center electrode element having a center electrode and a surrounding insulator body, said insulator body having an annular shoulder for engaging the annulus on said seat to secure the center electrode element and the ground electrode element in position in said cylinder head bore, said center electrode protruding into the combustion chamber and spaced apart from the ground electrode in the combustion chamber.

7. The spark plug of claim 6 further including locking means for cooperatively engaging the cylinder head and the insulator body to clamp the insulator body shoulder against the annulus on said seat, thereby securing the center electrode element and the ground electrode element in position in the cylinder head bore.

8. The spark plug of claim 7 wherein the locking means comprises an annular spanner retainer nut threadably received in a threaded portion of said bore about the insulator body to clamp the insulator body shoulder against the annulus on said seat.

9. The spark plug of claim 6 wherein said ground electrode element is formed of metal and is disposed on said seat in intimate electrical and thermal conductive contact with the cylinder head.

10. The spark plug of claim 6 wherein said elongated ground electrode element comprises an L-shaped electrode having an axial portion received in said slot and an inner end portion extending transversely of said axial portion in said combustion chamber so as to be spaced apart axially from the center electrode to define an axial spark gap therebetween.

* * * * *